US005915477A

United States Patent [19]

Stuebinger et al.

[11] Patent Number: 5,915,477

[45] Date of Patent: Jun. 29, 1999

[54] ENHANCED OIL RECOVERY TECHNIQUE

[75] Inventors: Lon Allan Stuebinger, Littleton, Colo.; Howard L. McKinzie; Kevin R. Bowlin, both of Sugarland, Tex.

[73] Assignee: Texaco Inc, White Plains, N.Y.

[21] Appl. No.: 08/785,313

[22] Filed: Jan. 21, 1997

[51] Int. Cl.[6] ..... E21B 43/24

[52] U.S. Cl. ..... 166/245; 166/269

[58] Field of Search ..... 166/245, 266, 166/268, 269

[56] References Cited

U.S. PATENT DOCUMENTS 5,246,071 9/1993 Chu ..... 166/245

5,497,832 3/1996 Stuebinger et al. ..... 166/369

*Primary Examiner*—William Neuder

*Attorney, Agent, or Firm*—Henry H. Gibson; William J. Beard

[57] ABSTRACT

This invention relates to enhanced oil recovery (EOR) techniques for improving the production economies and recovery efficiency of hydrocarbons from a reservoir after primary depletion has occurred. The reservoir has at least two production strata. At least one production well capable of producing fluids from both strata is placed into the reservoir. At least one injection well capable of injecting fluid into both strata is placed in the reservoir. At least one combination production/injection well for producing well fluid from only one of the strata is placed into the reservoir. The produced well fluid is separated into a mostly hydrocarbon component and a mostly water component in place downhole and reinjecting into the other of said strata the mostly water component by use of the combination production/injection well.

11 Claims, 5 Drawing Sheets

ENHANCED OIL RECOVERY TECHNIQUE

BACKGROUND OF THE INVENTION

1. Field of the Invention

This invention relates generally to enhanced oil recovery (EOR) techniques and, more particularly, for such techniques for improving the production economies and recovery efficiency of hydrocarbons from a reservoir after primary reservoir depletion has occurred.

2. Brief Description of the Prior Art

The present invention will be described with respect to enhanced oil recovery (EOR) techniques based on water flooding of a producing reservoir. It will be understood by those skilled in the art, that any or all EOR projects that inject fluids of any type for the purpose of increasing the recovery of hydrocarbon can be benefitted by the use of the concepts of the present invention. Similarly, the present invention will be described with respect to a system for EOR in which a deeper producing zone having contrasting permeability has recovery enhanced by the techniques of the present invention, but it will be understood by those of skill in the art that such techniques could also be employed to enhance production in shallower production zones having a contrasting permeability to the primary producing zone, or in both shallower and deeper production zones having a contrasting permeability than the primary producing zone, if desired. Moreover, while the present invention is described with respect to a particular injection/recovery well geometry, it will be appreciated by those skilled in the art that it could also be useful in other injection/recovery well geometries than those described herein.

In prior art water flooding techniques a pattern or geometrical arrangement of producing wells and injection wells are drilled into a producing formation. Water is pumped into the production interval from the water injection wells and "sweeps" the formation fluid toward the production wells where the formation fluid is produced to the surface by conventional lifting means, such as a surface driven pump, a submersible pump, a gas lift arrangement or the like. A particular geometry for such an operation could be the "five spot" geometry in which the injection wells are approximately spaced on the corners of a square of the desired dimension, as determined by formation permeability, fluid viscosity, etc., and the producing well is located at the center of the square. The injected water in the producing formation forces the formation fluids to move toward the producing well where it is pumped to the surface, separated into oil and water components, and the produced water is re-injected or carried away to be disposed of in other manners.

In such techniques, if the producing interval contains other zones having higher permeability and are not isolated from other nearby zones having higher permeability, then the injected water can preferentially go into such higher permeability zones and be "stolen" by such "thief zones." Problems of this type or "channeling" of injected fluids along the well bore into higher permeability zones or other zones due to improper cementing of casing or failed completion techniques can also result in the water being injected going into undesired permeable zones and not stimulating EOR recovery in the desired producing zone. Also in the prior art water flood recovery processes, as recovery proceeds, the water cut of the produced fluid increases. It is not uncommon in mature fields to produce fluid having 95% or greater water cut using these techniques. Of course, lifting 95% undesired fluid to the surface is not an efficient use of lifting processes.

BRIEF DESCRIPTION OF THE INVENTION

The foregoing and other problems associated with efficient EOR are addressed by the techniques of the present invention. U.S. Pat. No. 5,497,832, which is assigned to the assignee of the present invention and is incorporated herein by reference, teaches the use of a dual action pumping system to use the casing/tubing annulus in a producing well as a fluid separator. On the upstroke of the dual action pump, produced fluid, primarily oil, is pumped to the surface. On the downstroke of the dual action pump, the separated water is pumped to an injection zone separated from the producing zone by a packer. Similarly, U.S. patent application Ser. No. 08/581,862 filed Jan. 2, 1996, assigned to the assignee of the present invention and incorporated herein by reference, teaches the use of the casing tubing annulus in a production zone as a separator and the reinjection of produced water by the use of appropriately valued submersible pumps. There are other methods such as the use of downhole hydrocyclone or other type of separator to separate water for reinjection. Wells in which both production and injection are used may be referred to as dual purpose wells.

The use of dual purpose wells in EOR for specific water flooding techniques is taught by the subject invention. A producing interval is isolated from an injection interval in a dual purpose production/injection well placed in a particular geometry, such as the "five spot" pattern, or any other geometrical pattern. Rather than injecting water from the surface in the injection wells alone, the process is enhanced by re-injecting produced water separated out in the well bore by the use of the dual action production/injection well. As production proceeds the water cut does not increase as rapidly. The horizontal sweep efficiency, which in the past has been improved mainly by closer spacing of injection wells, is improved in the present techniques by the supplemental dual action production/injection wells affecting a change in areal sweep patterns. Vertical sweep efficiency is also enhanced by the use of the dual action production/injection wells being incorporated into the water flood patterns being used. This can avoid the use of a series of packers and flow regulators to restrict the amount of (injected) fluid entering more permeable intervals in the normal injection well. This can similarly avoid the even more radical approach to solving the vertical conformance problem by attempting to completely isolate more permeable zones in the wells (either producing or injection) by plugging, drilling separate wells to particular zones, partial completion of producing zones and multiple injection tubing strings to desired zones from the surface.

The techniques of the present invention are best understood by reference to the following detailed description thereof, when taken in conjunction with the accompanying drawings. The drawings and descriptions will be understood to be descriptive rather than limitative of the invention.

DESCRIPTION OF A PREFERRED EMBODIMENT

There has been effort to improve the economics of EOR projects by improving the efficiency by which injected fluids contact reservoir rock. Horizontal sweep efficiency refers to the ability of injected fluids to contact the areal extent of the reservoir. Vertical sweep efficiency refers to the ability of injected fluids to contact the vertical layers of rock that often vary in permeability. Dramatic differences in permeability between vertical layers often result in very little enhanced recovery in the tighter or less permeable intervals because injected fluids preferentially enter the more permeable intervals.

One approach to this problem in the past has been to inject long chain polymers or other such substances into the more permeable zones in order to lower permeability. Either injection wells or producing wells can be treated for this purpose. Such treatments produce the undesirable effect of lowering permeability when greater permeability would speed oil recovery. Also expensive diagnostic work may be required to gage the effect of such efforts and the injection of long chain polymers may be unsuccessful in accomplishing their purpose and require additional expensive workover to remediate the effects. Other attempts to achieve vertical conformance in the past have included plugging permeable zones with cement or resins, completing initially only a portion of the producing zone and then recompleting later after some production, drilling separate wellbores to different producing zones for low or high permeability injection at different rates or drilling very large diameter wellbores and isolating upper intervals from lower intervals with packers and multiple production/injection tubing strings. The present invention accomplishes improved horizontal and vertical sweep efficiency in an EOR process by augmenting or replacing production and injection wells with combination production/injection wells from the same borehole.

Figure 1:
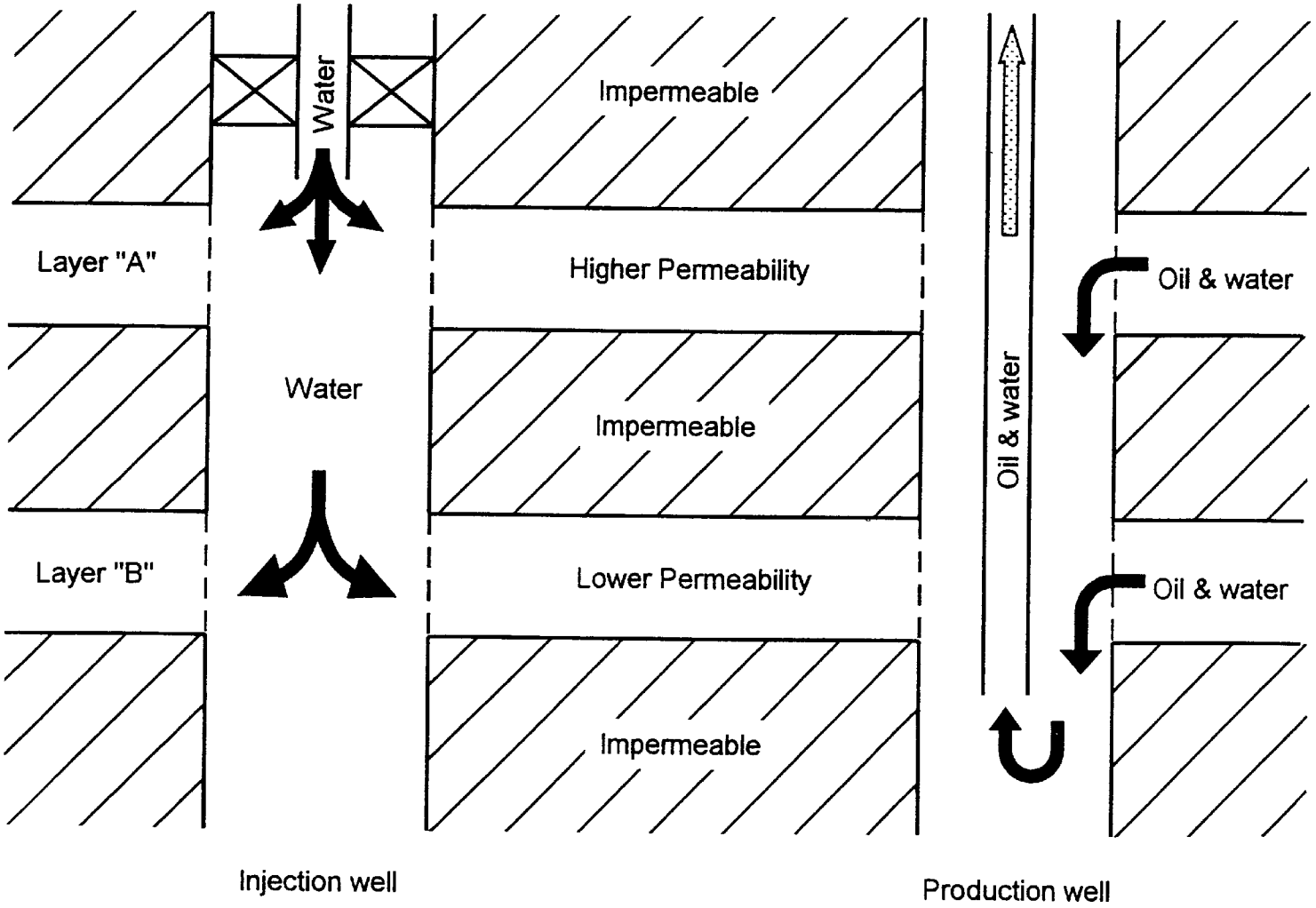
FIG. 1 is a schematic diagram in section showing a water injection EOR process according to the prior art for a multiple layer waterflood.

Referring now to FIG. 1 two layered reservoir (layer A and layer B) isolated by impermeable layers is shown for simplicity. Many vertical layers could actually occur in nature, it will be understood. In this example, layer A is more permeable than layer B in FIG. 1. Accordingly, most of the injected fluids in the injection well (as indicated by the arrows) enter zone A. If zone A has a high enough permeability difference from zone B, then little or no flood response may be achieved from the flood during the economics life of the flood.

Figure 2:
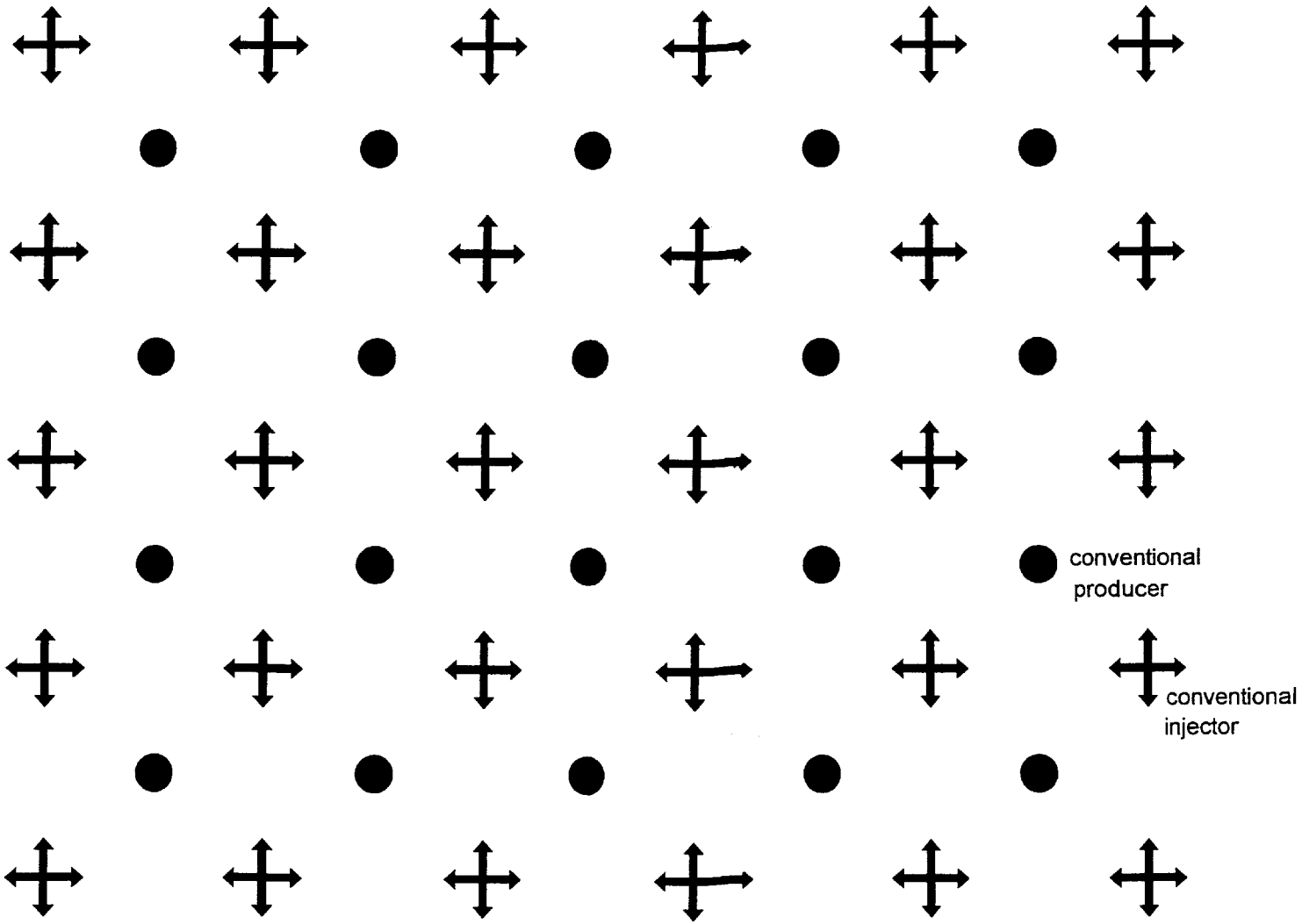
FIG. 2 is a schematic diagram showing the typical "5 spot" geometry for a water flood according to FIG. 1.

FIG. 2 shows the common "five spot" geometry of injector wells and producer wells. The injection wells have arrows pointing in 4 directions to indicate they are placing injected water into both zone A and zone B of FIG. 1. The producing wells are designated by the large dots and produce from both zone A and zone B. Standard practice in the prior art is to inject fluids into the injection wells driving the hydrocarbons, usually water, to the producing wells to be lifted to the surface. Of course produced nonhydrocarbons are also lifted to the surface and in a mature field can account for greater than 95% of the produced fluids.

Figure 3:
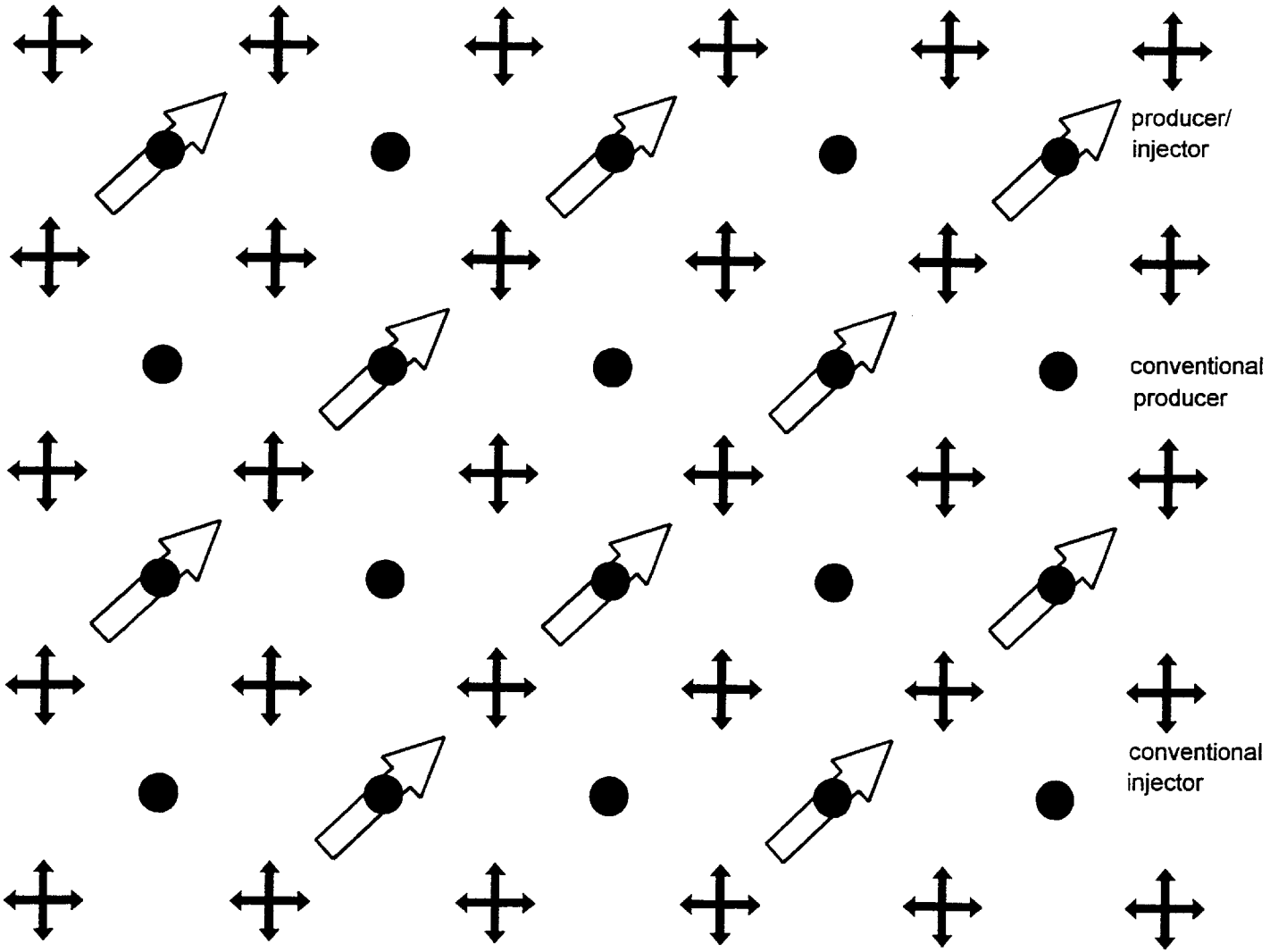
FIG. 3 shows a schematic diagram of the technique of the present invention used to enhance the recovery and efficiency of hydrocarbons in an EOR project similar to that of FIGS. 1 and 2.
Figure 4:
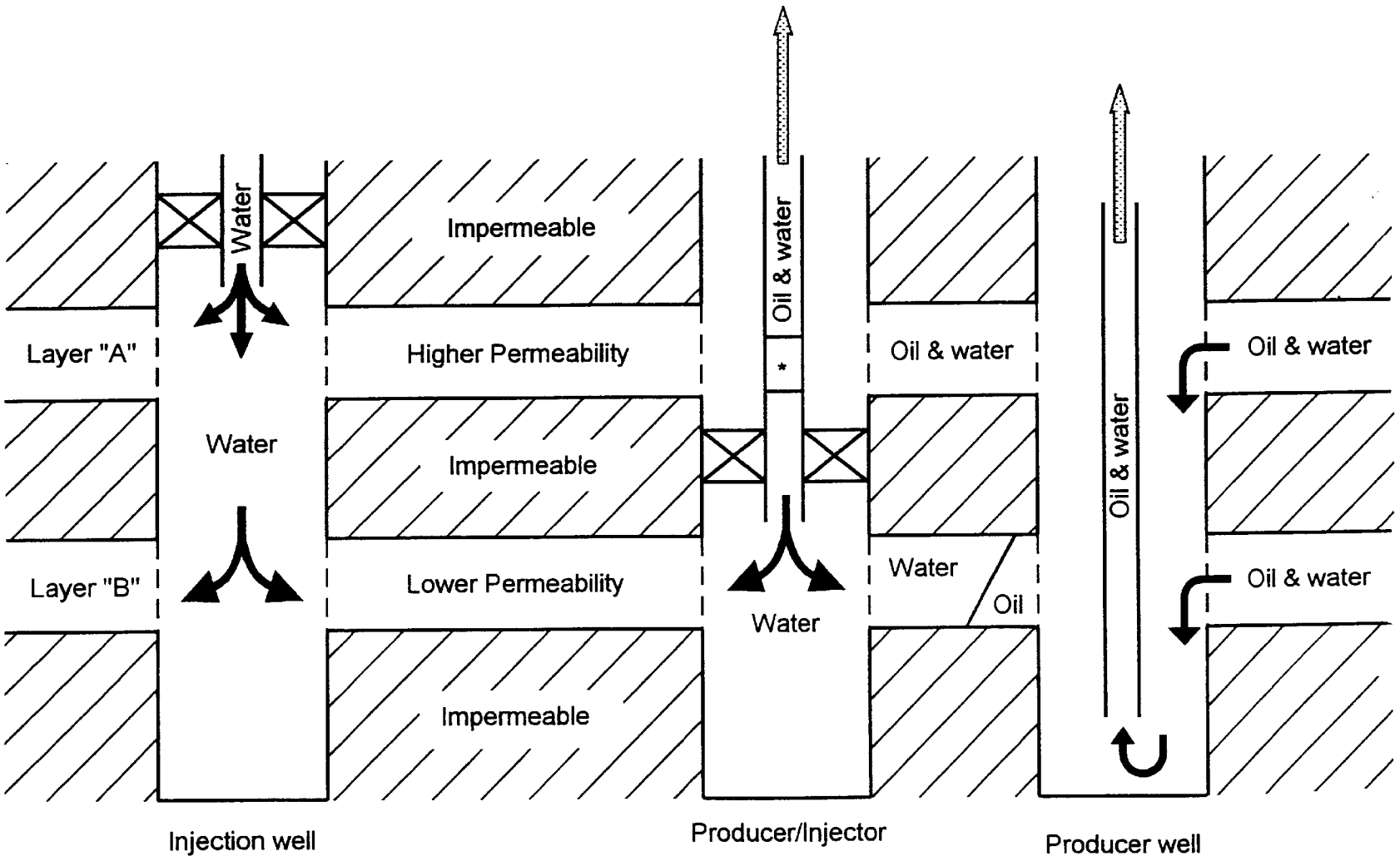
FIG. 4 shows the use of a dual action recovery/reinjection well according to concepts of the invention to enhance and EOR project similar to that of FIGS. 1 and 2. And, FIG. 5 shows a schematic diagram of how the techniques of the present invention may be employed to more economically water flood by the use of dual action production/reinjection wells in the EOR project pattern.

Referring now to FIG. 3, the effect of mechanically separating in the combination wellbore nonhydrocarbon fluids is shown. A dual action pump such as that disclosed in U.S. Pat. No. 5,497,832 or a system such as that described in the aforementioned co-pending and co-assigned patent application may be used in the combination producer/injector (projector wells) wells shown in FIG. 3 for this purpose. FIG. 4 shows schematically how this combination producer/injector well is arranged in the geometry of FIG. 3. In FIG. 3 the large hollow arrows indicate fluid produced from zone A is separated into oil and water and then reinjected into lower zone B as water only. This reinjected water into zone B supplements the relatively smaller volume of water injected into zone B by the conventional injection wells (4 arrows). All of the oil and about 20% to 50% water is lifted to the surface by conventional lifting means when produced in this manner.

Horizontal sweep efficiency is thus improved by the additional reinjection of water into zone B. Vertical sweep efficiency is improved also. When half or more of the produced fluids are reinjected immediately rather than being lifted to the surface, the cost of hydrocarbon lifting is significantly reduced. Ultimate hydrocarbon recovery is improved in the form of increased production from zone B. It will be noticed in FIG. 3, for example, that a secondary 5 spot pattern (rotated 45 degrees) is produced for zone B about each pure producing well in the improved pattern of combination injection/production wells as shown.

In FIG. 4 three wells are shown in cross section. Water is injected into both layer A and layer B by the injector well. Water and oil are produced in the combination production/injection well from zone A and the remaining water injected therefrom into layer B alone. This enhances oil production from layer B into the production well which produce from both zones A and B. In the pattern shown in FIG. 3 only alternate ones of the injection wells in the five spot pattern (in either direction) are converted into combination producer/injector wells. It will be appreciated that if desired, all of the injection wells could be so converted, or all of them in one direction as the other as desired and so on. Such pattern choices can be determined from the differences in permeability in layer A and layer B, or the like.

Figure 5:
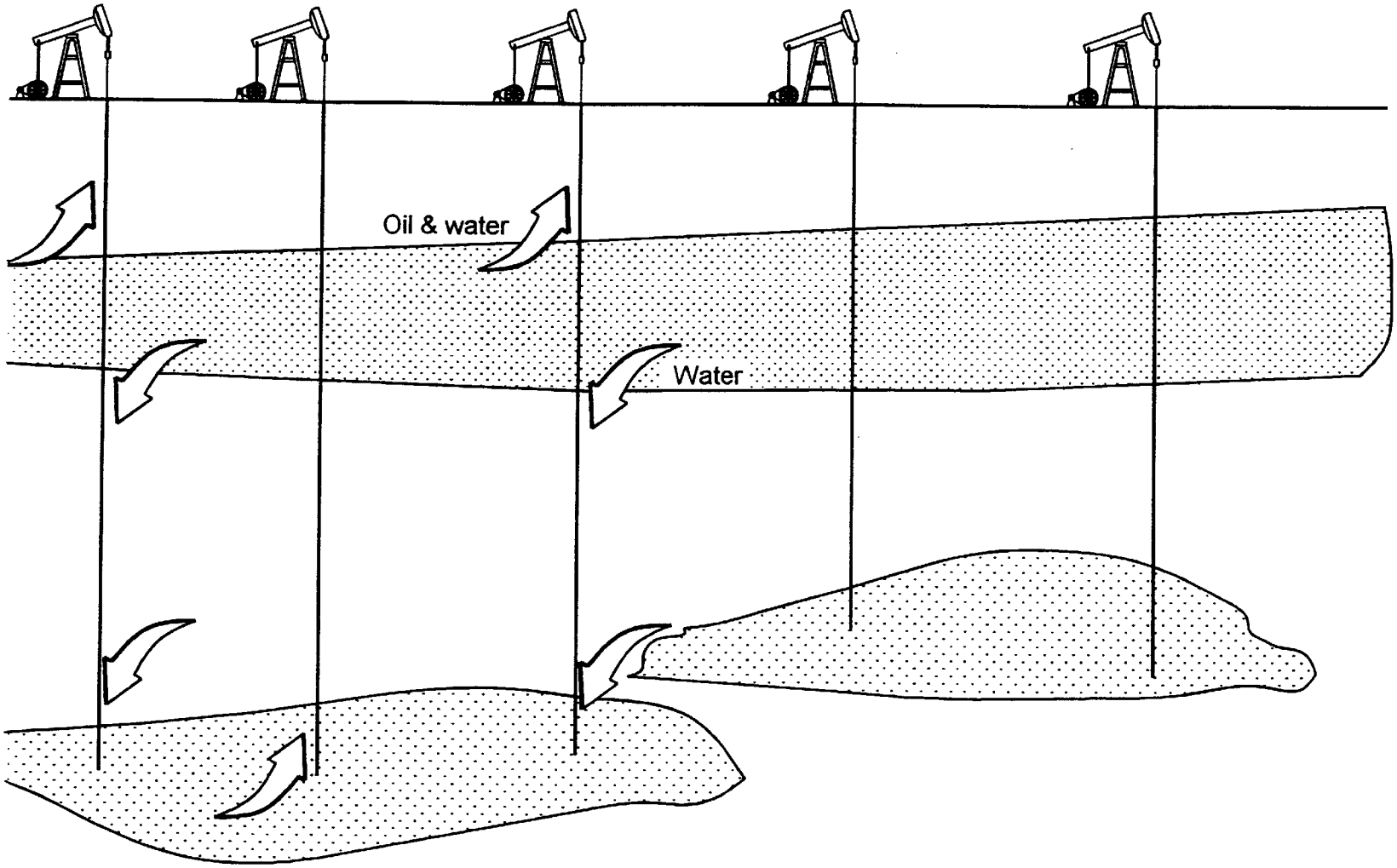

FIG. 5 shows schematically how a small reservoir can be economically flooded using the techniques of the present invention. Here a waterflood into a deeper small reservoir using solely water separated from oil from a shallower high water cut zone is produced. No water injection from the surface is required in this example for producing the waterflood in the deeper small reservoir. This can greatly reduce the expense of running a small scale waterflood.

As reservoir characterization and 3D seismic help to more accurately define isolated strata within fields (large or small), this technology will enable secondary recovery projects that have previously been deemed uneconomical. Previously the infrastructure (tanks, lines, pumps, etc) required for waterflooding made it uneconomical to install small waterfloods. This method enables waterfloods to be developed by using produced fluids from a shallower zone as the injection fluid without the associated costs of lifting, treating, and reinjecting it.

An additional benefit of this method is that waterflood injectors can sometimes be converted dual purpose wells. If shallower, high water cut production exists, it could be produced by recompleting injection wells to dual purpose. Direct revenues could be achieved from the shallower zone while maintaining injection into the deeper zone.

Summarizing, the techniques of the present invention utilize half or more of the non-hydrocarbon fluids (whether driven to the wellbore by primary pressure or by injected fluids in nearby wells). The hydrocarbons are driven to one or more dual purpose production/injection wells. Here the fluids are separated down hole into a mostly hydrocarbon and a mostly water component and the water component is reinjected into specific other intervals penetrated by the wellbore (usually deeper and less permeable) to generate additional production response in these intervals. Thus a significant fraction of the injected fluids are utilized to create a production response more than once before being lifted to the surface.

The foregoing descriptions may make other alternative arrangements according to the concepts of the invention apparent to those skilled in the art. The aim of the appended claims is to cover all such changes and modifications that fall within the true spirit and scope of the invention.

We claim:

1. A method for enhanced oil recovery in hydrocarbon reservoirs having at least two production strata comprising the step of:

placing at least one production well into said reservoir which is capable of producing well fluids from both of said production strata;

placing at least one injection well into said reservoir for injecting an enhanced recovery fluid into both of said production strata; and placing at least one combination production/injection well into said reservoir for producing well fluid from only one of said strata, separating the produced well fluid into a mostly hydrocarbon component and a mostly water component in place downhole, and reinjecting into the other of said strata said mostly water component.

2. The method of claim 1 wherein said at least two production strata comprise a more permeable strata and less permeable strata.

3. The method of claim 1 wherein said enhanced recovery fluid comprises water.

4. The method of claim 1 wherein said enhanced recovery fluid comprises a liquid phase non-hydrocarbon.

5. The method of claim 1 wherein said enhanced recovery fluid comprises steam.

6. The method of claim 1 wherein said enhanced recovery fluid comprises a water soluble long chain polymer in water.

7. The method of claim 1 wherein a two dimensional five spot geometry pattern of injection wells and producing wells is placed into said reservoir.

8. The method of claim 7 wherein alternate ones of said five spot geometry pattern of injection wells in at least one dimension are replaced with combination production/injection wells.

9. The method of claim 7 wherein alternate ones of said five spot geometry pattern of injection wells in both dimensions are replaced with combination production/injection wells.

10. The method of claim 1 wherein the step of reinjecting said mostly water component is performed by use of a dual action mechanical pump.

11. The method of claim 1 wherein the step of reinjecting said mostly water component is performed by use of dual electric submersible pump.

* * * * *